US007040727B2

(12) United States Patent
Ryu et al.

(10) Patent No.: US 7,040,727 B2
(45) Date of Patent: May 9, 2006

(54) APPARATUS FOR CONTROLLING POWER SUPPLY TO PRINTER AND METHOD THEREOF

(75) Inventors: Han-chung Ryu, Gyunggi-do (KR); Jong-yang Choo, Gyunggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 180 days.

(21) Appl. No.: 10/613,034

(22) Filed: Jul. 7, 2003

(65) Prior Publication Data

US 2004/0027400 A1 Feb. 12, 2004

(30) Foreign Application Priority Data

Jul. 15, 2002 (KR) ..... 2002-41367

(51) Int. Cl.
*B41J 29/38* (2006.01)

(52) U.S. Cl. ..... 347/5; 347/9; 347/3; 347/2

(58) Field of Classification Search ..... 347/5, 347/9, 2, 3; 358/406; 363/19; 323/282
See application file for complete search history.

(56) References Cited

U.S. PATENT DOCUMENTS 5,995,382 A * 11/1999 Miyazaki et al. ..... 363/19
6,529,292 B1 * 3/2003 Tsai ..... 358/406
2002/0125867 A1 * 9/2002 Choo et al. ..... 323/282

FOREIGN PATENT DOCUMENTS

| | | |
|---|---|---|
| CN | 1171645 | 1/1998 |
| CN | 1184372 | 6/1998 |
| CN | 1209593 | 3/1999 |

OTHER PUBLICATIONS

Chinese Office Action in Chinese App. No. 03147624.4 issued Sep. 30, 2005.

* cited by examiner

*Primary Examiner*—Hai Pham
*Assistant Examiner*—Lam S. Nguyen
(74) *Attorney, Agent, or Firm*—Staas & Halsey LLP

(57) ABSTRACT

An apparatus for and a method of controlling a power supply for a printer. A power on signal is automatically provided to turn on the printer power supply in accordance with a predetermined printing command, and a power off signal to turn off the printer power supply is automatically provided when the printer has not performed a printing operation for a predetermined time period. A low voltage and current switch is provided for manual on/off control of the printer power supply in accordance with an operation of a user. If the printer power supply in off, operation of the switch generates the power on signal. If the printer power supply is on, operation of the switch causes the controller to generate the power off signal to turn off the printer power supply.

28 Claims, 5 Drawing Sheets

FIG. 4A AC SIGNAL
FIG. 4B SW2
FIG. 4C POWER-ON SIGNAL
FIG. 4D POWER-OFF SIGNAL
FIG. 4E Vo1, Vo2
402
404
406
408
410
420
422
424
426

APPARATUS FOR CONTROLLING POWER SUPPLY TO PRINTER AND METHOD THEREOF

CROSS-REFERENCE TO RELATED APPLICATIONS

This application claims the benefit of Korean Application No. 2002-41367, filed Jul. 15, 2002, in the Korean Intellectual Property Office, the disclosure of which is incorporated herein by reference.

BACKGROUND OF THE INVENTION

1. Field of the Invention

The present invention relates to a printer to which power is supplied by a switch mode power supply (SMPS), and more particularly, to an apparatus for and a method of controlling a supply of power to a printer, to save power consumption by automatically turning on the power supply in accordance with a predetermined print command, and automatically turning off, or reducing the supply of power to the printer when there is no printing operation for a predetermined time period.

2. Description of the Related Art

A general printer prints image data originating in the printer, or external image data received from a connected host such as a computer on a paper with a medium such as ink or toner. Since the printer is operated only when a printing job is assigned, the printer does not always need electrical power for operation. However, as long as the printer is turned on, the printer is supplied with power even when the printer is not in the printing operation.

Generally, a switch mode power supply (SMPS) has been used for supplying power to the printer. A SMPS supplies power as required by the load of the printer. FIG. 1 shows a circuit diagram of a conventional SMPS, for supplying power to, for example, a control unit (or microcomputer) of the printer and peripheral devices of the printer.

Referring to FIG. 1, in the conventional SMPS, as the alternating current switch SW1 is turned on, an AC voltage is transformed into a DC voltage at a first rectifier circuit 101 so that the DC voltage is transmitted to a driving voltage supply unit 105 and a primary winding Np of a transformer. Initially, the driving voltage is not supplied to a pulse width modulation-IC (PWM-IC) 110 and accordingly, power is not switched in the primary winding Np. The driving voltage supply unit 105 comprises start-up resistors R1 and R2, a capacitor C1, a resistor R3 and a diode D1, and supplies a driving voltage Vcc to the PWM-IC 110. The capacitor C1 is charged with DC voltage from the first rectifier circuit 101 through the start-up resistors R1 and R2. As the voltage is charged to the capacitor C1, a driving voltage Vcc is supplied to the PWM-IC 110 through a terminal P1 of the PWM-IC 110. Accordingly, the PWM-IC 110 outputs, through a terminal P3, a control signal that controls switching of a field effect transistor FET which has a source and a drain serially connected with the primary winding Np. The control signal is applied to a GATE terminal of the FET through a resistor R4. As the FET is turned on, the primary winding Np of the primary side in a transformer 115 causes the power to be induced at secondary windings Ns1 and Ns2 of a secondary side of the transformer 115, and at an auxiliary winding Na.

As the power is induced at the auxiliary winding Na of the transformer 115, the PWM-IC 110 is supplied with driving voltage through the diode D1 and the resistor R3 of the driving voltage supply unit 105. If the FET is turned off and thus there is no power induced at the secondary winding Na, the PWM-IC 110 is supplied with the driving power from the electric current charged in the capacitor C1.

As described above, power induced at the secondary windings Ns1, Ns2, Na is determined in accordance with the switching of the FET. The FET switches in accordance with a duty cycle that is determined at the PWM-IC 110 based on a signal provided from a feedback unit 120 through a terminal P4 of the PWM-IC 110. The feedback unit 120 detects voltage Vo1 output to a control unit 130, and accordingly provides the terminal P4 of the PWM-IC 110 with the feedback signal to maintain the output voltage Vo1 at a constant value. The PWM-IC 110 measures a voltage across a resistor R5 which corresponds to a peak of a current which flows through the FET through a terminal P2 of the PWM-IC 110, and prevents an overcurrent from flowing through the FET. More specifically, upon sensing the overcurrent at the FET, the PWM-IC 110 controls the FET to stop switching and to remain in an off state.

Meanwhile, AC power, which is induced at the secondary windings Ns1 and Ns2, is rectified and smoothed into DC voltages V02 and V01, respectively. The DC voltage V02 is supplied by a diode D2 and capacitors C2 and C3 and supplies peripheral devices 125 and the DC voltage V01 is supplied by a diode D3 and capacitos C4 and C5 and supplies the control unit 130.

If the AC switch SW1 is turned off, the SMPS shown in FIG. 1 stops supplying power to the peripheral devices 125 and the control unit 130.

Accordingly, unless the AC switch SW1 is turned off, the conventional SMPS supplies the power to the control unit 130 and the peripheral devices 125. Thus, to save power, a user is required to turn off an AC switch of a corresponding system that is not in use. However, the user usually turns off the printer by manipulating on the power key on the printer panel, only cutting off power to some peripheral devices of the printer, but continuing to supply power to other peripheral devices. As a result, power is consumed unnecessarily.

A sleep mode has been suggested, in which, when the printer is determined not to have been operated for a predetermined time period, the power supply from the SMPS to all the peripheral devices is stopped, but the control unit continues to be supplied with power. The SMPS keeps supplying power to the control unit, and continues to make power available to the peripheral devices.

Since the conventional printer requires design specifications that enable the printer to be turned on all day, design cost for a power supplying device increases. Further, many users who turn off a computer having a connected printer after use leave the connected printer turned on. Accordingly, power is wasted.

The AC switch SW1 installed on the power supply line must have a sufficiently high rating to withstand utility AC voltages such as 110V or 220V. Accordingly, the price of the AC switch is high.

Finally, the AC switch SW1 is required to have a current capacity to withstand an inrush current that is incurred by smoothing capacitor (not shown) in the rectifier circuit every time the AC switch SW1 is turned on.

SUMMARY OF THE INVENTION

An aspect of the present invention is to provide a control apparatus for controlling power to a printer, which reduces power consumption by automatically turning on the printer either with the turning on of a host connected thereto, or in accordance with a predetermined printing command; and by automatically turning off the printer either with the turning off of the connected host, or when the printer is determined not to have been operated for a predetermined time period.

An aspect of the present invention is to provide a control method for controlling power to a printer, which reduces power consumption by automatically turning on the printer either with the turning on of a host connected thereto, or in accordance with a predetermined printing command; and by automatically turning off the printer either with the turning off of a connected host, or when the printer is determined not to have been operated for a predetermined time period.

An aspect of the present invention is to provide a power supply apparatus for a printer, which reduces power consumption for a standby mode, and reduces power consumption when the printer is not in operation and requires a switch for controlling power to the printer which has a low withstanding voltage requirement.

Additional aspects and advantages of the invention will be set forth in part in the description which follows and, in part, will be obvious from the description, or may be learned by practice of the invention.

In order to achieve the above and/or other aspects and advantages of the present invention, a printer power supply controlling apparatus provided in a printer comprises a printer driving power supply which rceives power from an external power supply and generates a voltage for driving the printer, a printer driving power supply controlling unit which controls the printer driving power supply, a switch which is switchable on or off according to a manipulation of a user, a power-off signal detection driving unit which switches off the printer driving power supply in response to a detection of a predetermined power-off signal and a switch-on detection transmitting unit which detects whether the user switch is in an on state, and upon detecting that the user switch is in the on state, transmits the switch-on signal to the printer driving power supply controlling unit. When the switch-on signal is received at the printer driving power supply controlling unit with the printer driving power supply on, the printer driving power-off signal is generated by the printer driving power supply controlling unit and transmitted to the power-off signal detection driving unit, to turn off the printer driving power supply.

Further provided is a power-on signal detection driving unit which turns on the printer driving power supply when a predetermined printer driving power-on signal is detected.

The power-on signal detection driving unit may comprise a first switching device that switches on in response to the printer driving power-on signal, and a first photo coupler driven in response to the switching on of the first switching device to turn on the printer driving power supply.

The printer driving power-on signal may be generated to turn on the printer driving power supply when a host such as a computer, which is connected with the printer, is turned on.

The printer driving power-on signal may be generated to turn on the printer driving power supply in response to a predetermined printing command received from a host such as a computer, which is connected with the printer.

The power-off signal detection driving unit may comprise a second switching device that switches on in response to the printer driving power-off signal, and a second photo coupler driven in response to the switching on of the second switching device to turn off the printer driving power supply.

The printer driving power-off signal may be generated to turn off the printer driving power supply when a predetermined time has elapsed after the setting of the printer to a sleep mode.

The printer driving power-off signal is generated to turn off the printer driving power supply when a host, such as a computer, which is connected with the printer, is turned off.

The printer driving power-off signal may be generated to turn off the printer driving power supply when the printer does not perform a printing operation for a predetermined time.

The switch-on detection transmitting unit may comprise a third photo coupler which is driven in response to the switching on of the switch, to transmit the switch-on signal to the printer driving power supply controlling unit.

In order to achieve the above and/or other aspects and advantages of the present invention, there is provided a method of controlling a printer power supply which is provided in a printer and which receives power from an external power source, to generate a voltage for driving the printer, a printer driving power supply controlling unit which controls the printer driving power supply, and a switch which switches on or off according to a manipulation of a user. The printer power supply controlling method comprises controlling the printer driving power supply, where the printer driving power supply is on, to turn off the printer driving power supply either when the switch is switched on, or when a predetermined printer driving power-off signal is generated.

The method of controlling the printer driving power supply comprises setting the switch to the on-state while the printer driving power supply is on and generating a switch-on signal in response, transmitting the switch-on signal to the printer driving power supply controlling unit, generating a power-off signal in the printer driving power supply controlling unit, and transmitting the power-off control signal to the printer driving power supply, to turn off the printer driving power supply.

The method of controlling may further comprise controlling the printer driving power supply to be on when, in a state that the printer power supply is in off state, either the switch is set to on-state or a predetermined printer driving power-on signal is generated.

The controlling of the printer driving power supply to be on may further comprise generating the printer driving power-on signal to turn on the printer driving power supply when a host, such as a computer connected with the printer, is turned on.

The controlling of the printer driving power supply to be on may further comprise, generating the printer driving power-on signal to turn on the printer driving power supply in response to a predetermined printing command from a host such as a computer, which is connected with the printer.

The controlling of the printer driving power supply to be off may further comprise, generating the printer driving power-off signal to turn off the printer driving power supply when a predetermined time has elapsed after a setting of the printer to a sleep mode.

The controlling of the printer driving power supply to be off may further comprise, generating the printer driving power-off signal to turn off the printer driving power supply when a host such as a computer, which is connected with the printer, is turned off.

The controlling of the printer driving power to be off may further comprise, generating the printer driving power-off signal to turn off the printer driving power supply when the printer does not perform a printing operation for a predetermined time.

In order to realize the above and/or other aspects and advantages of the present invention, a power supply apparatus for reducing power consumption for a standby operation comprises a first rectifier circuit which rectifies an AC voltage and outputs a first resultant voltage, a transformer having a primary winding which receives the first resultant voltage, and at least one secondary winding coupled with the primary winding, a field effect transistor (FET) installed to turn on/off a supply of electric current to the primary winding, at least one second rectifier circuit which rectifies a voltage induced at the secondary winding and outputs a second resultant voltage, a feedback unit which compares the second resultant voltage from the second rectifier circuit] and a target value, and outputs a feedback signal according to the comparison result, a pulse width modulator which controls an on/off state of the FET in response to the feedback signal, and a switch which, when manipulated by a user, selectively causes the feedback unit to selectively output a signal that causes the pulse width modulator to turn off the FET regardless of the output voltage of the second rectifier circuit.

The feedback unit may comprise a photo coupler comprising a photo diode having one end connected with the second resultant voltage, to illuminate the photo diode in response to a current flow through the diode, and a photo transistor which applies a signal corresponding to the illumination of the photo diode to the pulse width modulator as the feedback signal, and an error amp which turns the photo diode on and off in accordance with the comparison result.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
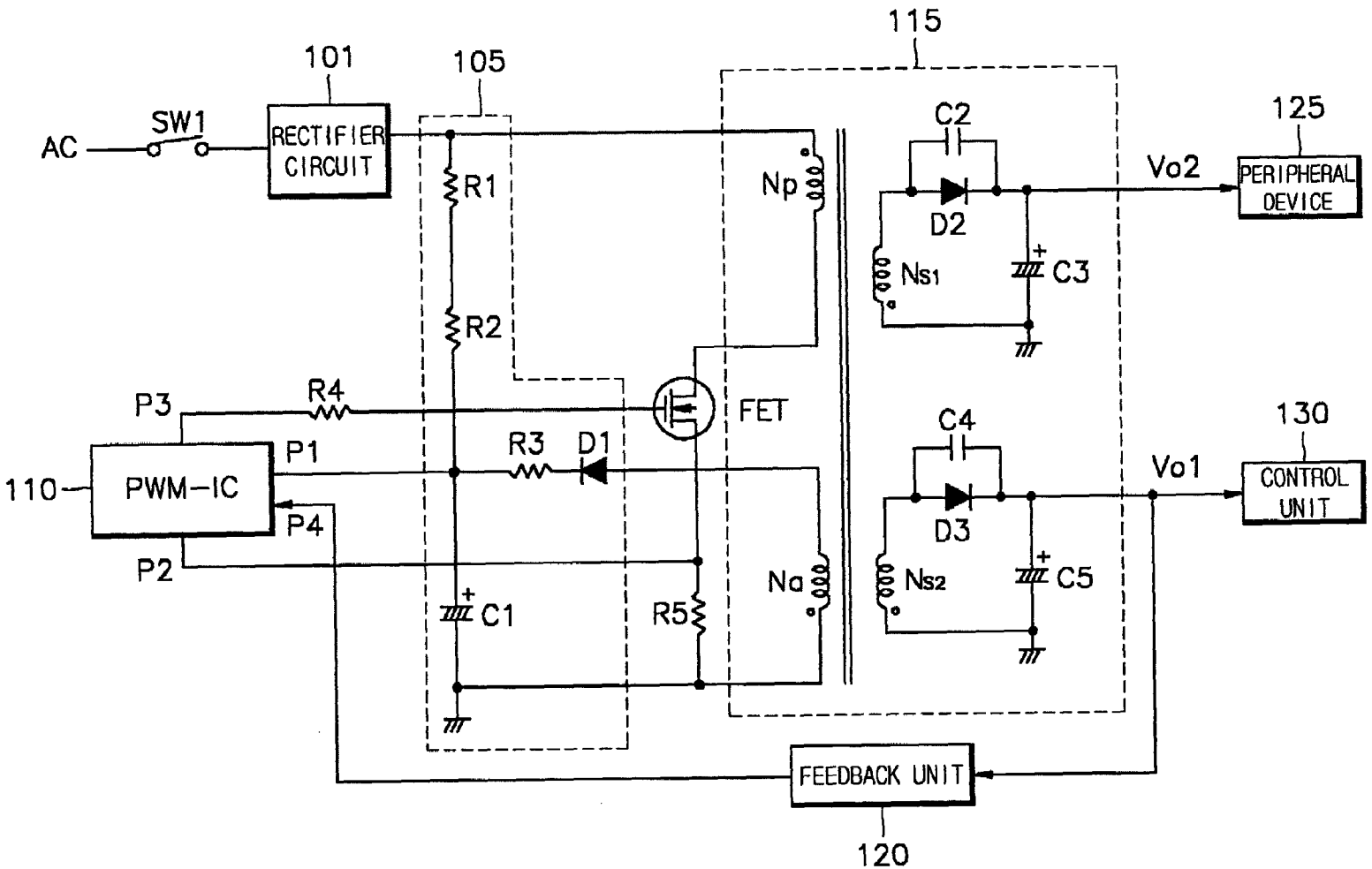
FIG. 1 (PRIOR ART)
FIG. 1 is a circuit diagram of a conventional switching mode power supply.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
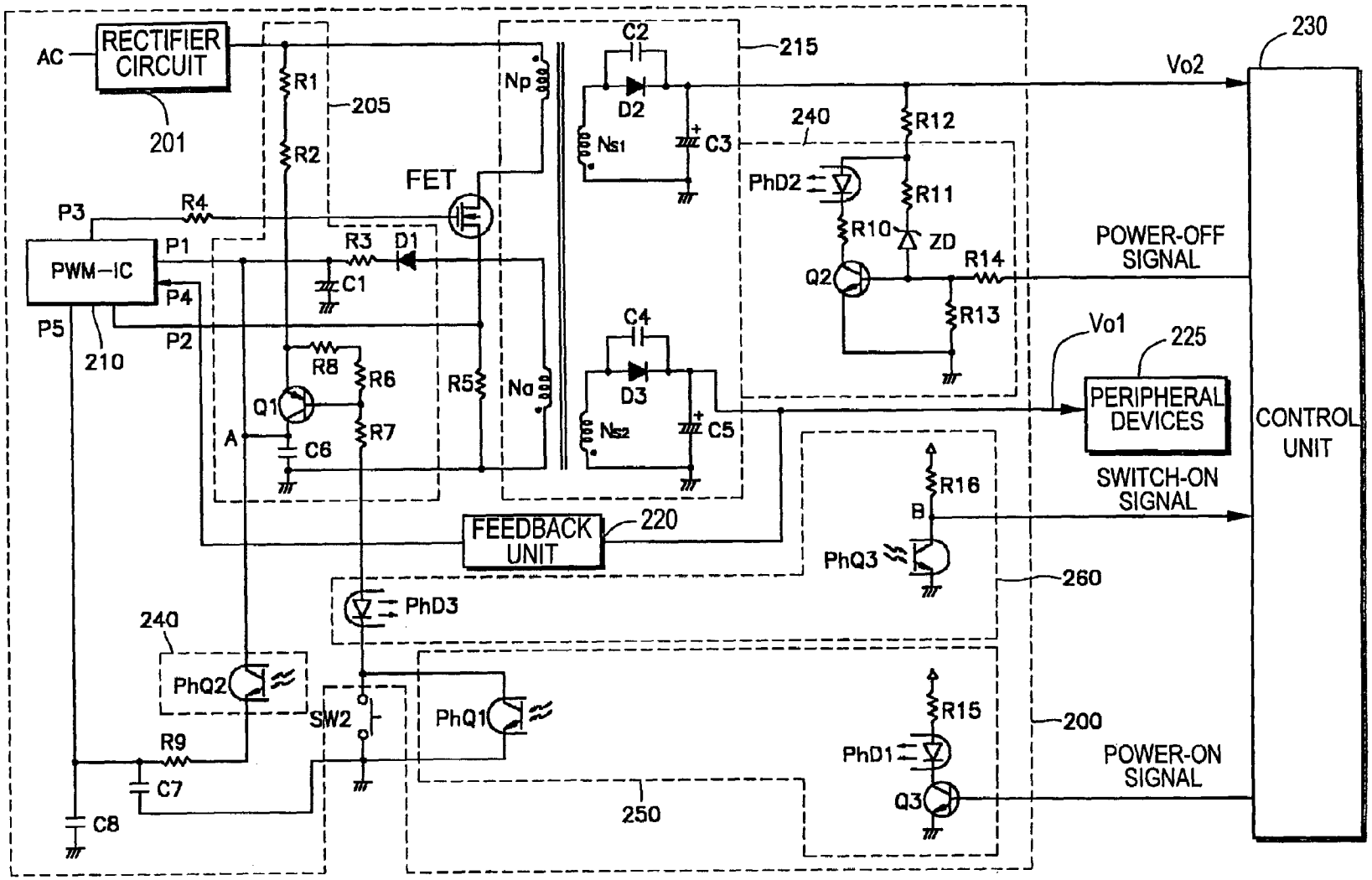
FIG. 2 is a circuit diagram of a power supply control apparatus according to an embodiment the present invention.

FIG. 2 is a circuit diagram illustrating a power supply control apparatus that controls power supply to a printer according to the present invention. Referring to FIG. 2, the power supply control apparatus according to the present invention comprises a SMPS function unit 200, a switch SW2 and a control unit 230.

The SMPS function unit 200 comprises a first rectifier circuit 201, a driving voltage supply unit 205, a pulse width modulating unit (PWM-IC) 210, a transformer 215, a field effect transistor FET, a feedback unit 220, a power-off signal detecting/overvoltage preventing unit 240, a power-on signal detecting unit 250, a switch-on signal detecting unit 260, resistors R4, R9 and R12, and capacitors C7 and C8.

The switch SW2 has a structure of a tact switch. Accordingly, the switch SW2 is turned on only for a duration that an operator contacts the switch SW2 such as pressing, and is turned off as soon as the operator ceases contact with the switch, i.e., as the operator stops pressing the switch.

As the AC voltage is supplied, the first rectifier circuit 201 rectifies the supplied voltage and accordingly outputs a DC voltage. The output DC voltage is supplied to the driving voltage supply unit 205 and the transformer 215. At this time, no driving voltage Vcc is supplied to the PWM-IC 210 and the FET is in an off state, thus power is not induced at the transformer 215. As a result, even with the supply of the AC power, the SMPS function unit 200 does not supply power to the control unit 230 and the peripheral devices 225. The peripheral devices 225 are internal constituents of the printer exclusive of the control unit 230, which require power for operation.

The driving voltage supply unit 205 comprises resistors R1, R2, R3, R6, R7, R8, capacitors C1 and C6 and a PNP type transistor Q1, and supplies driving voltage to the PWM-IC 210. However, unlike the conventional power supply apparatus as shown in FIG. 1, a driving voltage is not supplied to the PWM-IC 210 unless the switch SW2 is turned on during a startup, because the transistor Q1 stays in an off state as long as the switch SW2 is turned off. Accordingly, the SMPS function unit 200 is in power-off mode. As the switch SW2 is pressed in the power-off mode, the transistor Q1 is switched on, and accordingly, the DC voltage supplied through the start-up resistors R1, R2 is supplied to a terminal P1 of the PWM-IC 210 through a contact point A between the transistor Q1 and the capacitor C6. As a result, the PWM-IC 210 outputs a switching control signal to the FET through a terminal P3 of the PWM-IC 210.

As the FET is switched, power is induced at secondary windings Ns1, Ns2 and an auxiliary winding Na of the transformer 215. Accordingly, power which is induced in the secondary winding NS1 is supplied through a capacitor C2 and a diode D2, smoothed by a capacitor C3, and provided to the peripheral devices 225; and power which is induced in the secondary winding NS2 is supplied through a capacitor C4 and a diode D3, smoothed by a capacitor C5, and provided to the control unit 225.

With the power induced at the auxiliary winding Na, the driving voltage is supplied from the charged voltage of the capacitor C1 through the terminal P1 of the PWM-IC 210 the switching of the FET is continuously controlled without the switch SW2 being pressed. The PWM-IC 210 adjusts duty cycle of the FET with the signal from the feedback unit 220 to the terminal P4.

As described above, as the SMPS function unit 200 is turned on and corresponding power is supplied, the control unit 230 checks whether the internal peripheral devices 225 of the printer operate. If the control unit 230 determines that the peripheral devices 225 have not operated for a predetermined time corresponding to a sleep mode, the control unit 230 outputs a power-off signal in an active state. The active state is referred to as 'high' level in this embodiment.

The power-off signal detecting/overvoltage preventing unit 240 detects the power-off signal. The power-off signal detecting/overvoltage preventing unit 240 comprises a photo-coupler comprising a photo diode PhD2 and a photo transistor PhQ2, resistors R10, R11, R13 and R14, and a zener diode ZD. Accordingly, when the power-off signal is applied from the control unit 230 at the high level, the transistor Q2 is switched on, and the photo diode PhD2 illuminates. As a result, the photo transistor PhQ2 is switched on, so that the driving power supply to the terminal P1 of the PWM-IC 210 is connected to an on/off control terminal P5 of the PWM-IC 210. The signal applied to the on/off control terminal P5 of the PWM-IC 210 is a high level signal. The PWM-IC 210 is turned off, and the switching of the FET is stopped. As a result, the SMPS function unit 200 enters a power-off state.

When the SMPS function unit 200 is in the power-on mode, the power-off signal detecting/overvoltage preventing unit 240 may be driven to prevent supply of overvoltage to the control unit 230. That is, in the case the power Vo2 is higher than a predetermined zener voltage of the zener diode ZD, the transistor Q2 is switched on and the photo diode PhS2 illuminates. As a result, the photo transistor PhQ2 is switched on, and PWM-IC 210 stops switching the FET. As the SMPS function unit 200 is set to the power-off mode, power supply to the peripheral devices 225 and the control unit 230 is stopped.

The switch-on signal detecting unit 260 detects whether the switch SW2 is turned on. The switch-on signal detecting unit 260 comprises a photo coupler comprising a photo diode PhD2 and a photo transistor PhQ3, and a resistor R16. As the switch SW2 is turned on, the photo diode PhD3 of the switch-on detecting unit 260 illuminates. The photo transistor PhQ3 is switched on, and the logic power supplied through the resistor R16 is pulled down through the photo transistor PhQ3. Accordingly, if the switch-on signal, being supplied through the contact point B between the photo transistor PhQ3 and the resistor R16, is received at the control unit 230 while the printer is on, a power-off signal is generated by the control unit 230 to turn the printer off which is on. Meanwhile, if the power-on signal is detected through the power-on signal detecting unit 260 with the SMPS function unit 200 setting in the power-off mode, the transistor Q1 of the driving voltage supply unit 205 is switched on, allowing the driving voltage to the PWM-IC 210. As a result, the SMPS function unit 200 is set to the power-on mode, and supplies power to the peripheral devices 225 and the control unit 230.

Describing it in greater detail, the power-on signal detecting unit 250 comprises a photo coupler comprising a photo diode PhD1 and a photo transistor PhQ1, a transistor Q3 and a resistor R15. The photo diode PhD1 may be provided outside of the SMPS function unit 200. With the supply of the power-on signal in a high level, the transistor Q3 is switched on and the photo diode PhD1 illuminates. The photo transistor PhQ1 is switched on in response to the illumination of the photo diode PhD1 and the transistor Q1 of the driving voltage supply unit 205 is in turn switched on in response to a base current of transistor Q1 flowing through the resistor R7. As a result, the driving voltage is supplied to the PWM-IC 210. The power-on signal detected at the power-on detecting unit 250 may be a signal that is generated from the control unit 230, and the signal may be received when the SMPS function unit 200 is in power-off mode.

That is, the power-on signal may be applied from the control unit 230 even during a time that the power is not supplied from the SMPS function unit 200 to the control unit 230, and this will be described in detail with reference to FIG. 3.

Figure 3:
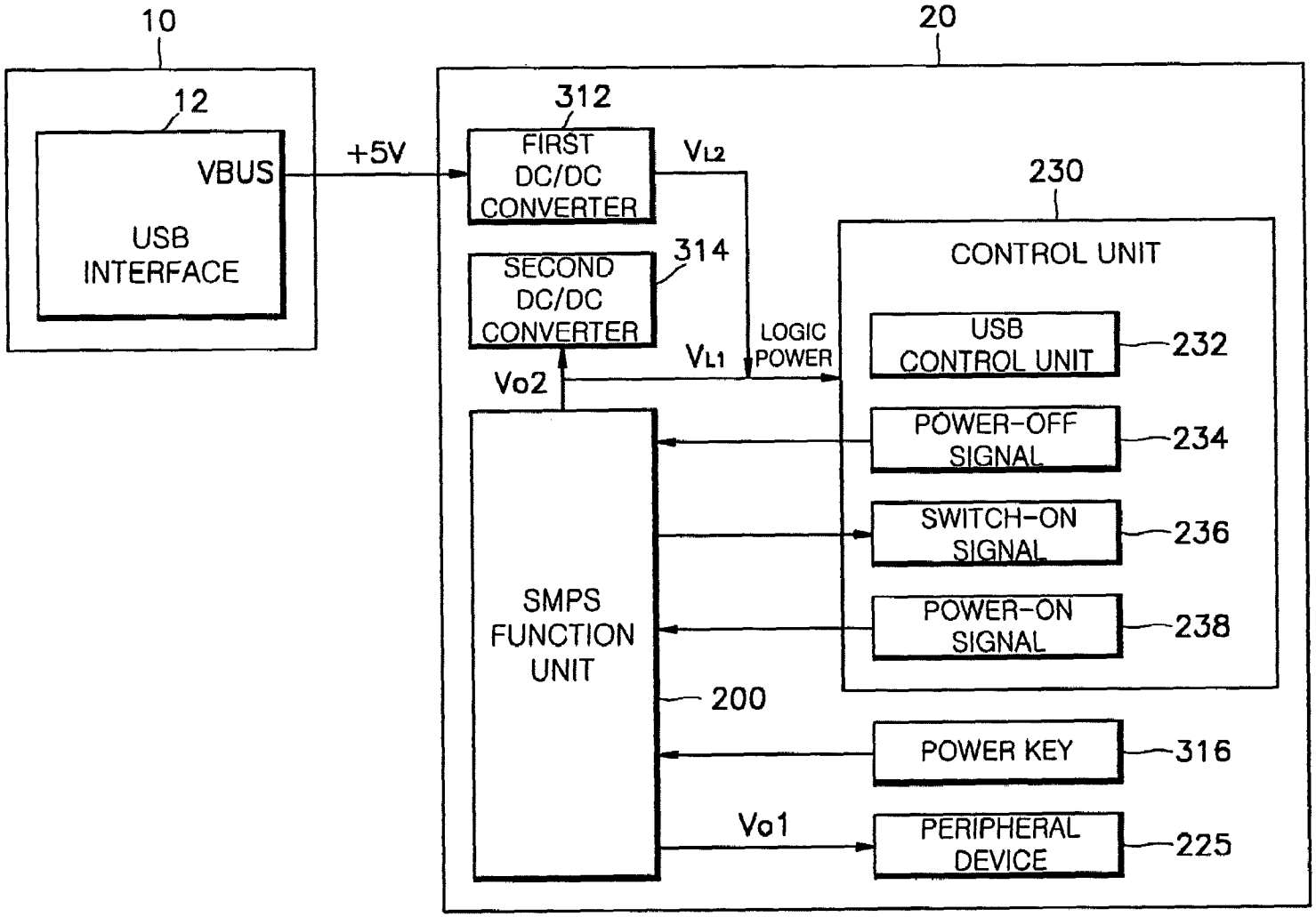
FIG. 3 is a block diagram illustrating logic power being supplied to the control unit of the printer.

FIG. 3 is a block diagram illustrating the logic power $V_{L1}$, $V_{L2}$ being supplied to the control unit 230 of the printer.

Referring to FIG. 3, a host 10, which will be adapted to a computer by way of one example, is connected to another equipment, namely, a printer 20, to transmit printing data. For the sake of clarity, FIG. 3 only shows a VBUS line of USB interface 12. The host supplies a +5V voltage.

The printer 20 comprises an SMPS function unit 200, a peripheral device 225, a control unit 230, a USB control unit 232, a first DC/DC converter 312, a second DC/DC converter 314, and a power key 316. The voltage, namely +5V, from the host 10 is supplied to the first DC/DC converter 312, which generates a logic power $V_{L2}$ for the control unit 230. The logic power $V_{L2}$ is used as a driving voltage for a logic unit (not shown) of the printer 10 in case the SMPS function unit 200 is in the power-off mode. Accordingly, even when the SMPS function unit 200 is in a power-off mode, the SMPS function unit 200 can switch to power-on mode with the supply of power-on signal. The second DC/DC converter 314 generates logic power from the +5V voltage Vo2 supplied from the SMPS function unit 200. The USB control unit 230 controls the host 10 and the USB interface of the printer 20, and receives either a printer power-on command or a power-off command from the host 10.

The power-off signal 234 is generated, and transmitted from the control unit 230 to the SMPS function 200 to set the SMPS function unit 200 to power-off mode when: the printer 20 having being set to a sleep mode stays in the sleep mode more than a predetermined time, the host 10 connected with the printer 20 is turned off, or the printing operation is not performed at the printer for a predetermined time. In the case that the host 10 is turned off, the power-off command is received from the host 10 through the USB interface.

The switch-on signal 236 is generated and transmitted from the SMPS function unit 200 to the control unit 230 in the case that either the switch SW2, or the power key 316 on a printer panel (Op Panel) is switched on. In the case that the switch SW2 is switched on with the printer on, the switch-on signal 236 is sent from the SMPS function unit 200 to the control unit 230, and the control unit 230 sends out the power-off signal 234 to the SMPS function unit 200. Accordingly, the printer is turned off. This arrangement permits the switch SW2 to effectively provide both the power on and the power off modes of the SMPS.

The power-on signal 238 is generated and transmitted from the control unit 230 to the SMPS function unit 200 to set the SMPS function unit 200 to the power-on mode when, first, the host 10 connected with the printer 20 is turned on, or second and more preferably, when a predetermined printing command from the host 10 connected with the printer 20 is provided. As described above, voltages Vo1, Vo2 are supplied to, or cut from the control unit 230 and the peripheral device 225 depending on the switch SW2, power-on signal 238 and the power-off signal 234.

For more understanding on the present invention, the power supply controlling apparatus will be described below with reference to FIGS. 4A–4E. A power-off-power-on region 420 provided by operation of the switch SW2 will be described. As the switch SW2 switches to on-state 402 as shown in FIG. 4B with the SMPS function unit 200 being applied with AC power as shown in FIG. 4A, the level of voltages Vo1, Vo2 from the SMPS function unit 200 to the peripheral device 225 and the control unit 230 changes from a low state to a high state as shown in FIG. 4E, indicating that power is supplied to the peripheral device 225 and the control unit 230.

Next, power-on and power-off regions in accordance with the power-off signal are described. While the peripheral device 225 and the control unit 230 are being supplied with the power, the power-off signal may change from low to high level as shown by waveform 408 in FIG. 4D. Where the power off signal changes from the low level to the high level, the SMPS function unit 200 is in the power-off mode, and the voltages Vo1, Vo2 to the peripheral device 225 and the control unit 230 change from the high to the low state as indicated in a region 422 as shown in FIG. 4E, indicating that power to the peripheral device 225 and the control unit 230 is stopped. The power-off signal is generated in the cases such as when the printer 20 having been set to sleep mode stays in the sleep mode more than a predetermined time, when the host 10 connected with the printer 20 is turned off, or when the printer 20 has not performed a printing operation for a predetermined time.

Figure 4:
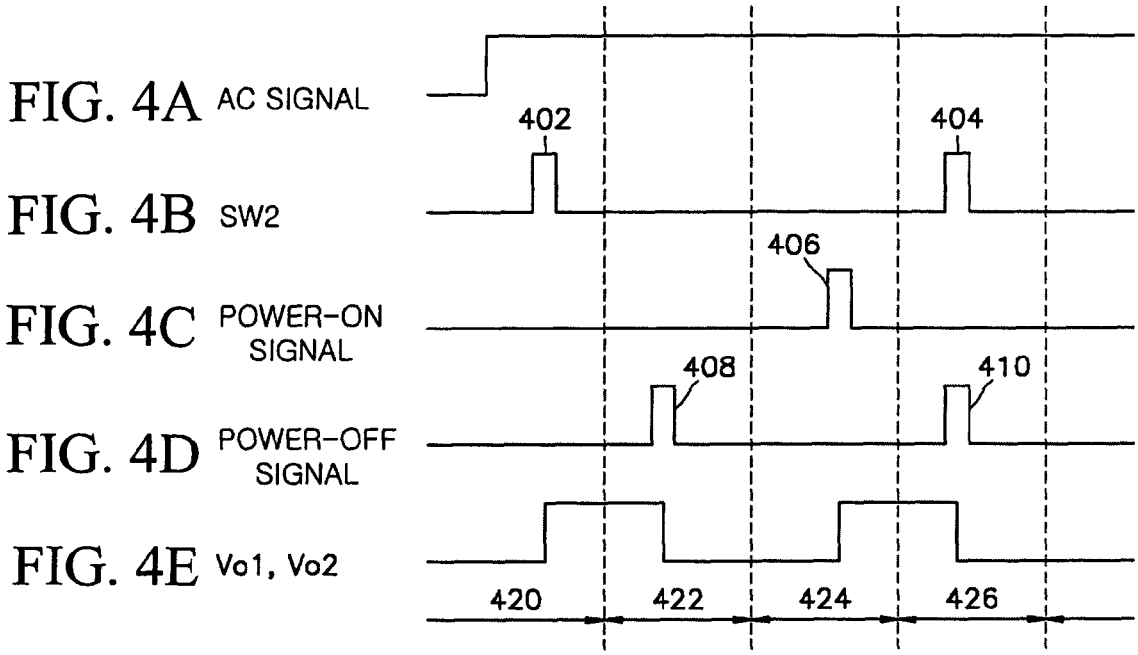
FIGS. 4A–4E are views for explaining an operation of the power supply control apparatus according to the present invention.

Next, a power-off-power-on region 424 in response to the power-on signal as shown in FIG. 4E will be described. When the power-on signal changes from low to high level as shown in FIG. 4C, (c, 406) in the state that power supply to the peripheral device 225 and the control unit 230 is not being supplied, the SMPS function unit 200 changes to power-on mode and the voltages Vo1, Vo2 to the peripheral device 225 and the control unit 230 change from the low state to the high state as shown in FIG. 4E. The power-on signal is generated when the host 10 connected with the printer 20 is turned on, or when a predetermined printing command from the host 10 connected with the printer 20 occurs.

Lastly, a power-on-power-off region 426 in response to operation of the switch SW2 will be described. When the switch SW2 switched on in a state that the power is supplied to the peripheral device 225 and the control unit 230, the switch-on signal as indicted by waveform 404 in FIG. 4B is transmitted from the SMPS function unit 200, the control unit 230 outputs the power-off signal as indicated by waveform 410 in FIG. 4D, turning the SMPS function unit 200 off. Accordingly, the voltages Vo1, Vo2 to the peripheral device 225 and the control unit 230 change from the high state to the low state as shown in the region 426 of FIG. 4E, and power supply to the peripheral device 225 and the control unit 230 is stopped.

Figure 5:
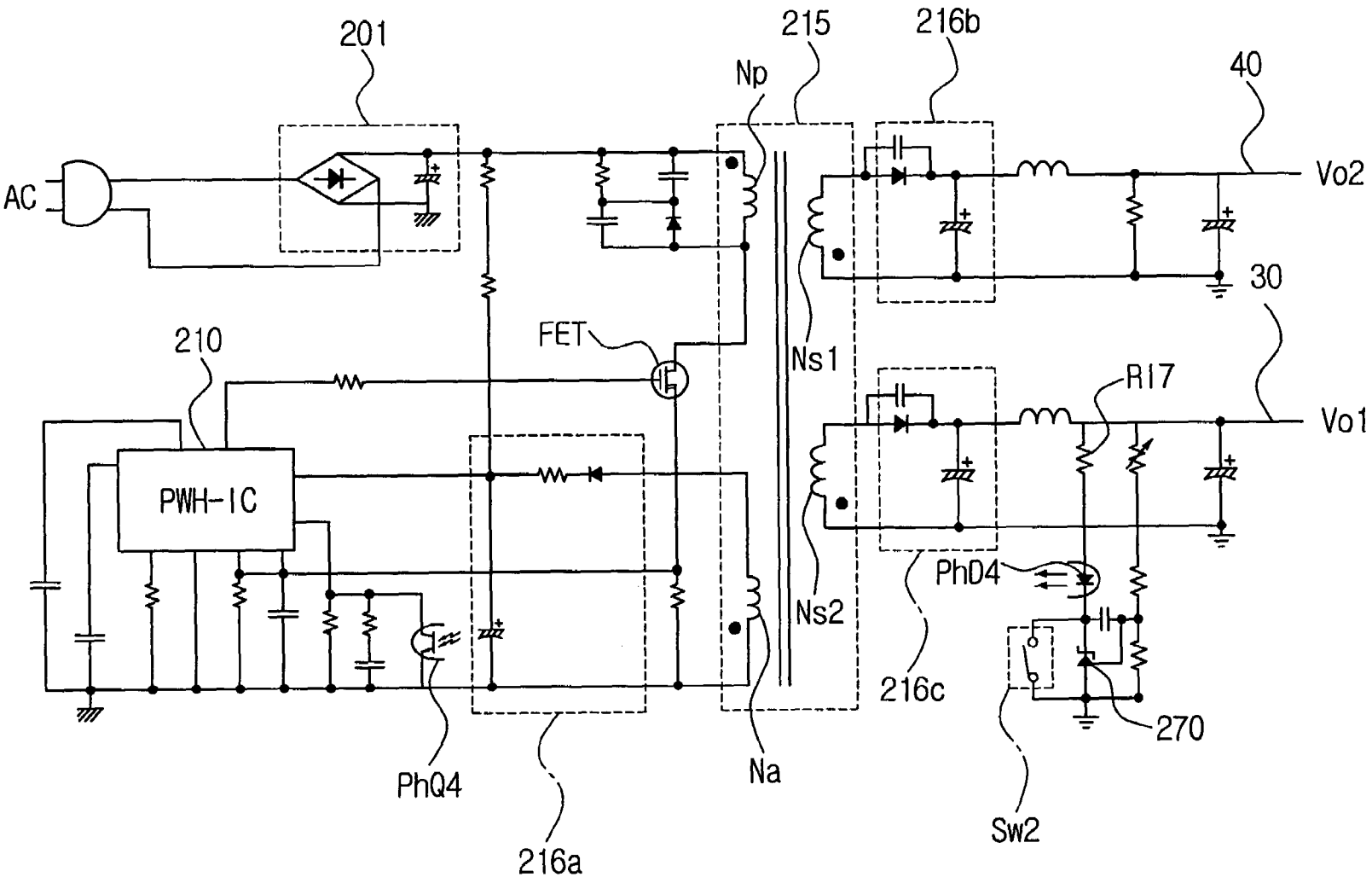
FIG. 5 is a circuit diagram illustrating a power supply control apparatus according to another embodiment of the present invention.

Referring now to FIG. 5, another embodiment of the present invention, a printer power supply controlling apparatus reduces power consumption for a standby mode.

The power supply controlling apparatus shown in FIG. 5 comprises a first rectifier circuit 201, a transformer 215, a field effect transistor FET, a PWM-IC 210, a second rectifier circuit 216, a shunt regulator 270, and a photo coupler comprising a photo diode PhD4 and a photo transistor PhQ4.

The first rectifier circuit 201 rectifiers and smoothes the input of AC utility power.

The transformer 215 comprises a primary winding Np, two secondary windings Ns1 and Ns2 and an auxiliary winding Na. A number of secondary windings may vary appropriately in accordance with the number of power supplies of respective levels that are required by a system which incorporates the present embodiment. As shown in FIG. 5, the auxiliary winding Na which supplies power to the PWM-IC 210 and the secondary windings Ns1 and Ns2 which supplies power to the voltage requiring device, are electromagnetically coupled to the primary winding Np of transformer 215.

The windings Ns1, Ns2 and Na are wound in a flyback manner with respect to the primary winding Np for inducing voltage. However, there are many known coupling methods such as forward coupling, and many of these may be adapted to the present invention.

The primary winding Np is connected to receive a serial voltage generated from the first rectifier circuit 201.

The field effect transistor FET is installed to control a current path loop from the first rectifier circuit 201 through the primary winding Np. In this embodiment, a high voltage switching element is adapted as the field effect transistor FET.

The second rectifier circuit 216 comprises rectifier circuits 216*a*, 216*b*, and 216*c* which rectify and smooth the voltages induced at the windings Na, Ns1 and Ns2, respectively.

To an output end 30 of the rectified voltage Vo1 from the secondary winding Ns2, a resistor R17, a photo diode PhD4 as one constituent of the photo coupler, and a shunt regulator 270 are connected in series, forming an electric current path. Together with the shunt regulator 270, the photo diode PhD4 and the photo transistor PhQ4 are adapted as a part of a feedback unit.

The shunt regulator 270 is adapted as an error amp, and is connected to receive a voltage drop signal for comparison through a gate terminal and from an output of a voltage divider that is connected in series with the Vol output.

The voltage divider outputs an input voltage to the shunt regulator 27 so that the shunt regulator 270 is turned on as the output voltage Vo1 reaches a target value.

The switch SW2 is installed such that the switch SW2 bypasses the shunt regulator 270 when the switch SW2 is switched on. Considering that the output voltage Vo1 from the rectifier circuit 216*c* is only several volts, a switch SW2 having withstanding voltage and current of several tens times lower than a general AC utility power switch may be used to control the power on and power off functions for the power supply.

The PWM-IC 210 controls a duty cycle of turning on/off of the transistor FET in accordance with the switching on/off of the photo transistor PhQ4. The photo transistor PhQ4 is switched on with the illumination of the photo diode PhD4.

According to the power supply apparatus of FIG. 5, as described above, the PWM-IC 210 controls duty of turning on/off of the FET so that the output voltage from the second rectifier circuit 216 can stably maintain a target voltage.

Accordingly, if the Vo1 output voltage increases above predetermined value, the shunt regulator 270 is turned on, the photo diode illuminates, and the transistor FET is switched off until the shunt regulator 270 is turned off, i.e., until the Vo1 voltage decreases to the predetermined value.

If the Vo1 decreases below the predetermined value that amounts to the opening of the shunt regulator 270, the photo diode PhD4 stops illuminating. The PWM-IC 210 is driven to switch the transistor FET. The above processes repeat with controlling on the duty so that the output voltage can maintain the predetermined target value.

If the switch SW2 is turned on, current passes through the photo diode PhD4 regardless of the shunt regulator 270. Accordingly, the photo diode PhD4 illuminates, and the PWM-IC 210 turns off the switching of the transistor FET. As the switch SW2 is switched on, the FET is switched off regardless of the voltage and load at the output end, resulting in substantial cutoff of the power supply to the output end.

Accordingly, with the switch SW2 being extended outside of the power supply apparatus for an easy handling of the user, a user may use the switch SW2 to block the supply of power to the voltage requiring device.

Referring again to FIGS. 2, 3 and 4A–4E, with the power supply controlling apparatus and the method of controlling the power supply according to the present invention, either when the host 10 connected with the printer 20 is turned on, or in accordance with a predetermined printing command from the host 10, the printer is automatically turned on, without requiring a user to press a printer power key. When the host 10 is turned off, or when there has been no printing operation for a predetermined time, the printer is set to a sleep mode. Then, if there still has been no printing operation for a predetermined time after the setting of the sleep mode, the printer may be turned off. Since the printer is usually used discontinuously, power consumption of the printer is greatly reduced.

Furthermore, employment of a tact switch instead of a conventional AC switch enables the user to turn on/off the printer easily, and when the printer is turned off, the tact switch substantially blocks power supply from the SMPS to the control unit and peripheral device, and thus reduces unnecessary power consumption in the SMPS.

With the printer power supply controlling apparatus that reduces standby power consumption according to the present invention, a switch having a withstanding voltage and current of several ten times lower than an AC utility power switch can be used, while still ensuring the cutoff of the power to the voltage requiring device.

Although a few embodiments of the present invention have been shown and described, it would be appreciated by those skilled in the art that that changes may be made in these embodiments without departing from the principles and spirit of the invention, the scope of which is defined in the claims and their equivalents.

What is claimed is:

1. A printer power supply controlling apparatus provided in a printer, comprising:

a printer driving power supply which receives power from an external power and generates a voltage for driving the printer;

a printer driving power supply controlling unit which controls the printer driving power supply;

a switch which is switchable on or off according to a manipulation of a user;

a power-off signal detection driving unit which switches off the printer driving power supply in response to a detection of a predetermined printer driving power-off signal; and a switch-on detection transmitting unit which detects whether the user switch is in an on state, and upon detecting that the user switch is in the on state, transmits a switch-on signal to the printer driving power supply controlling unit, wherein:

when the switch-on signal is received at the printer driving power supply controlling unit with the printer driving power supply on, the printer driving power-off signal is generated by the printer driving power supply controlling unit and transmitted to the power-off signal detection driving unit so as to turn off the printer driving power supply.

2. The printer power supply controlling apparatus of claim 1, further comprising a power-on signal detection driving unit which turns on the printer driving power supply when a predetermined printer driving power-on signal is detected.

3. The printer power supply controlling apparatus of claim 2, wherein the power-on signal detection driving unit comprises a first switching device that switches on in response to the printer driving power-on signal, and a first photo coupler driven in response to the switching on of the first switching device to turn on the printer driving power supply.

4. The printer power supply controlling apparatus of claim 3, wherein the printer driving power-on signal is generated to turn on the printer driving power supply when a host, which is connected with the printer, is turned on.

5. The printer power supply controlling apparatus of claim 3, wherein the printer driving power-on signal is generated to turn on the printer driving power supply when there is a predetermined printing command received from a host, which is connected with the printer.

6. The printer power supply controlling apparatus of claim 2, wherein the printer driving power-on signal is generated to turn on the printer driving power supply when a host, which is connected with the printer, is turned on.

7. The printer power supply controlling apparatus of claim 2, wherein the printer driving power-on signal is generated to turn on the printer driving power supply in response to a predetermined printing command received from a host, which is connected with the printer.

8. The printer power supply controlling apparatus of claim 1, wherein the power-off signal detection driving unit comprises a second switching device that switches on in response to the printer driving power-off signal, and a photo coupler driven in response to the switching on of the second switching device to turn off the printer driving power supply.

9. The printer power supply controlling apparatus of claim 8, wherein the printer driving power-off signal is generated to turn off the printer driving power supply when a predetermined time has elapsed after the printer is set to a sleep mode.

10. The printer power supply controlling apparatus of claim 8, wherein the printer driving power-off signal is generated to turn off the printer driving power supply when a host, which is connected with the printer, is turned off.

11. The printer power supply controlling apparatus of claim 8, wherein the printer driving power-off signal is generated to turn off the printer driving power supply when the printer does not perform a printing operation for a predetermined time.

12. The printer power supply controlling apparatus of claim 8, wherein the switch-on detection transmitting unit comprises a second photo coupler which is driven in response to the switching on of the switch to transmit the switch-on signal to the printer driving power supply controlling unit.

13. The printer power supply controlling apparatus of claim 1, wherein the printer driving power-off signal is generated to turn off the printer driving power supply when a predetermined time has elapsed after the printer is set to a sleep mode.

14. The printer power supply controlling apparatus of claim 1, wherein the printer driving power-off signal is generated to turn off the printer driving power supply when a host, which is connected with the printer, is turned off.

15. The printer power supply controlling apparatus of claim 1, wherein the printer driving power-off signal is generated to turn off the printer driving power supply when the printer does not perform a printing operation for a predetermined time.

16. The printer power supply controlling apparatus of claim 1, wherein the switch-on detection transmitting unit comprises a photo coupler which is driven in response to the switching on of the switch to transmit the switch-on signal to the printer driving power supply controlling unit.

17. A method of controlling power, which is provided in a printer and which receives power from an external power supply, and to generate a voltage for driving the printer, a printer driving power supply controlling unit which controls a printer driving power supply, and a switch which switches on or off according to a manipulation of a user, the method comprising:

setting the switch to the on-state while the printer driving power supply is on and generating a switch-on signal in response;

transmitting the switch-on signal to the printer driving power supply controlling unit;

generating a power-off control signal with the printer driving power supply controlling unit; and transmitting the generated power-off control signal to the printer driving power supply, to turn off the printer driving power supply.

18. The method of claim 17, further comprising:

controlling the printer driving power supply to turn on when the printer power supply is in an off-state and either the switch is set to the on-state or a predetermined printer driving power-on signal is generated.

19. The method of claim 18, wherein the controlling of the printer driving power supply to be turned on further comprises:

generating the printer driving power-on signal to turn on the printer driving power supply when a host, connected with the printer, is turned on.

20. The method of claim 18, wherein the controlling of the printer driving power supply to be turned on further comprises:

generating the printer driving power-on signal to turn on the printer driving power supply in response to a predetermined printing command from a host, which is connected with the printer.

21. The printer power supply controlling method of claim 19, wherein the controlling of the printer driving power supply to be on further comprises:

generating the printer driving power-on signal to turn on the printer driving power supply in response to a predetermined printing command from a host, which is connected with the printer.

22. The printer power supply controlling method of claim 17, wherein the generating the power-off control signal further comprises:

generating the printer driving power-off signal to turn off the printer driving power supply when a predetermined time has elapsed after a setting of the printer to sleep mode.

23. The printer power supply controlling method of claim 17, wherein the generating the power-off control signal further comprises:

generating the printer driving power-off signal to turn off the printer driving power supply when a host, which is connected with the printer, is turned off.

24. The printer power supply controlling method of claim 23, wherein the generating the power-off control signal the controlling of the printer driving power supply to turn off further comprises:

generating the printer driving power-off signal to turn off the printer driving power supply when a host, which is connected with the printer, is turned off.

25. The printer power supply controlling method of claim 23, wherein generating a power-off control signal the controlling of the printer driving power to be turned off further comprises:

generating the printer driving power-off signal to turn off the printer driving power supply when the printer does not perform the printing operation for a predetermined time.

26. The printer power supply controlling method of claim 17, wherein the generating a power-off control signal further comprises:

generating the printer driving power-off signal to turn off the printer driving power supply when the printer does not perform a printing operation for a predetermined time.

27. An apparatus for providing power to a printer, comprising:

a controller;

a user operable switch; and a switching mode power, comprising:

a transformer which converts primary power to secondary power in response to repetitive switching of a current in a primary winding of the transformer and supplies the secondary power to the printer, an electronic switch which performs the repetitive switching in response to a pulse width modulated (PWM) control signal, and a pulse width modulator which outputs the PWM control signal in response to a power on control signal output by the controller or by an operation of the user operable switch and stops the output of the PWM control signal in response to a power off control signal;

wherein the controller:

generates the power on control signal in response to a predetermined printing command, if the PWM control signal is not currently being output to the electronic switch;

generates the power off control signal in response to a determination that a printing operation has not occurred for a predetermined period of time; and generates the power off signal in response to an operation of the user operable switch, if the PWM control signal is currently being output to the electronic switch.

28. The apparatus of claim 27, further comprising:

a photo coupler comprising a photo diode and a photo transistor, the photo diode serially connected between the user operable switch and an input of the PWM modulator and which communicates the operation of the user operated switch to the PWM modulator, the photo transistor having a collector connected to an input of the controller and a base which optically communicates with the photo diode, wherein:

if the PWM control signal is currently being output to the electronic switch and the user operable switch is operated, the photo diode and the photo transistor communicate a signal to the controller to output the power off signal to the PWM modulator.

* * * * *

UNITED STATES PATENT AND TRADEMARK OFFICE

CERTIFICATE OF CORRECTION

PATENT NO. : 7,040,727 B2
APPLICATION NO. : 10/613034
DATED : May 9, 2006
INVENTOR(S) : Han-chung Ryu et al.

It is certified that error appears in the above-identified patent and that said Letters Patent is hereby corrected as shown below:

On the title page item (57), Abstract, Line 4, change “power off” to --power-off--

On the title page item (57), Abstract, line 13, change “power off” to --power-off--

Column 14, line 24 change “power off” to --power-off--

Column 14, line 31 change “power off” to --power-off--

Column 14, line 34 change “power off” to --power-off--

Column 14, line 50 change “power off” to --power-off--

Signed and Sealed this

Twenty-first Day of November, 2006

JON W. DUDAS
*Director of the United States Patent and Trademark Office*